United States Patent [19]

Shaub et al.

[11] Patent Number: 4,479,883

[45] Date of Patent: Oct. 30, 1984

[54] LUBRICANT COMPOSITION WITH IMPROVED FRICTION REDUCING PROPERTIES CONTAINING A MIXTURE OF DITHIOCARBAMATES

[75] Inventors: Harold Shaub, Berkeley Heights; Barbara J. Schaeffer, Elizabeth, both of N.J.

[73] Assignee: Exxon Research & Engineering Company, Florham Park, N.J.

[21] Appl. No.: 582,052

[22] Filed: Feb. 21, 1984

Related U.S. Application Data

[63] Continuation of Ser. No. 337,416, Jan. 6, 1982, abandoned.

[51] Int. Cl.[3] ..... C10M 1/48

[52] U.S. Cl. ..... 252/32.7 E; 252/33.6

[58] Field of Search ..... 252/32.7 E, 33.6

[56] References Cited

U.S. PATENT DOCUMENTS

| | | | |
|---|---|---|---|
| 3,139,405 | 6/1964 | Farmer et al. | 252/33.6 |
| 3,180,832 | 4/1965 | Furey | 252/56 R |
| 3,429,817 | 2/1969 | Furey et al. | 252/565 |
| 3,630,897 | 12/1971 | Rohde et al. | 252/33.6 |
| 3,772,197 | 11/1973 | Milsom | 252/33.6 X |
| 3,988,249 | 10/1976 | Gencarelli et al. | 252/33.6 |
| 4,105,571 | 8/1978 | Shaub et al. | 252/32.7 E |
| 4,178,258 | 12/1979 | Papay et al. | 252/33.6 X |

*Primary Examiner*—Andrew Metz

*Attorney, Agent, or Firm*—Eugene Zagarella

[57] ABSTRACT

A lubricating oil composition having particularly improved friction reducing properties which comprises an ester of a polycarboxylic acid with a glycol or glycercol and a selected metal dithiocarbamate and contains a relatively low level of phosphorus.

9 Claims, No Drawings

Best Available Copy

LUBRICANT COMPOSITION WITH IMPROVED FRICTION REDUCING PROPERTIES CONTAINING A MIXTURE OF DITHIOCARBAMATES

This is a continuation of application Ser. No. 337,416, filed Jan. 6, 1982 and now abandoned.

BACKGROUND OF THE INVENTION

This invention relates to a lubricating oil composition having particularly improved friction reducing properties. More particularly, this invention is directed to a lubricating oil composition which contains a combination of an ester of polycarboxylic acid and glycol or glycerol with a selected metal dithiocarbamate to provide improved friction reducing properties.

There has been considerable effort in recent years to develop lubricating oil compositions which will reduce friction in engines, and particularly, automotive engines. This effort is based on the need to improve the fuel economy of such engines which operate on petroleum fuel, a product having a declining source of supply and escalating price. It is known that high engine friction causes significant energy loss and thus, one way to improve fuel economy is to reduce such friction.

Known ways to solve the problem of energy losses due to high friction e.g., in crankcase motor oils include the use of synthetic ester base oils which are expensive and the use of insoluble molybdenum sulfides, which have the disadvantage of giving the oil composition a black or hazy appearance.

Various friction reducing additives have been disclosed in the art as well as many other additives known for providing antioxidant, antiwear, corrosion inhibiting and other useful properties. While such known additives may in fact satisfy one or more of these properties, it is also known that many additives act in a different physical or chemical manner and often compete with one another, e.g., they may compete for the surface of moving metal parts which are subjected to lubrication. Accordingly, extreme care must be exercised in the selection of these additives to insure compatibility and effectiveness.

One additive combination found in lubricating oil compositions and providing excellent antifriction and antiwear properties is an ester of a polycarboxylic acid with glycol and zinc dihydrocarbyl dithiophosphate as disclosed in U.S. Pat. No. 4,105,571. A number of oil soluble molybdenum compounds have been disclosed as useful to provide different lubricant oil properties such as antiwear and friction reduction as shown; e.g., in U.S. Pat. Nos. 4,164,473; 4,176,073; 4,176,074; 4,192,757; 4,248,720; 4,201,683 and 4,289,635, as well as Japanese Pat. No. 56000896.

Another particular group of additives which have been widely used in lubricant compositions are the metal dihydrocarbyl dithiophosphates. These compounds are known to exhibit antioxidant and antiwear properties. While such compounds have been quite successful in providing such improved properties in lubricant compositions, they do contain phosphorus which has been known to cause some deterioration problems in certain catalyst containing automotive systems.

Accordingly, there is the need for providing a lubricant oil composition having friction reducing properties and a limited or relatively reduced level of phosphorus content while retaining other desired properties such as viscosity stability.

SUMMARY OF THE INVENTION

It has now been discovered that lubricating oil compositions containing a combination of an ester of a polycarboxylic acid and glycol or glycerol with a selected metal dithiocarbamate derivative have particularly improved friction reducing properties. It has additionally been found that lubricating oil compositions containing this additive combination have such improved friction reducing properties even when limited amounts of phosphorus containing compounds such as the metal dialkyl dithiophosphates are used and still retain other desired lubricant properties.

In accordance with the present invention, a lubricating oil composition with improved friction reducing properties is provided by a composition comprising a major amount of lubricating oil, from about 0.05 to about 2 parts by weight of an ester of a polycarboxylic acid with a glycol or glycerol and from about 0.1 to about 2 parts by weight of metal dithiocarbamate having the formula:

$$A[SCSNR_2]_x \qquad (I)$$

where A is a metal selected from the group consisting of molybdenum, zinc and antimony; each R is an alkyl group of 1 to 22 carbon atoms; and X is an integer of 1 to 3 depending on the particular A group used. The dithiocarbamate component (I) can also be a combination of a metal derivative as defined above with a compound where A is 1,2 dicarboethoxyethyl. All weights of said composition based on 100 parts by weight of lubricating oil composition.

DETAILED DESCRIPTION OF THE INVENTION

As previously indicated, the present invention relates to a lubricating oil composition having particularly improved friction reducing properties and which contains an ester of a polycarboxylic acid with a glycol or glycerol and a selected metal dithiocarbamate.

The oil soluble friction reducing ester component used in the composition of this invention generally, can be any hydroxy substituted oil soluble ester of a polycarboxylic acid.

Best results are, however, obtained when such compounds are derived from the esterification of a polycarboxylic acid with a glycol or glycerol, preferably glycol. Such an ester may be a partial, di- or polyester with typical formulas of the ester represented by the following general formulas when using a glycol:

$$HO—R—OOC—R''—COOH \qquad (1)$$

$$HO—R—OOC—R''—COOR'—OH \qquad (2)$$

$$HO—R—OOC—R''—COOR—OOC—R''—COOR'—OH \qquad (3)$$

wherein R'' is the hydrocarbon radical of said acid and each R and R' may be the same or different hydrocarbon radicals associated with a glycol or diol as hereinafter defined. It will, of course, be appreciated that esters of the type illustrated by the foregoing formulas can be obtained by esterifying a polycarboxylic acid, or a mixture of such acids, with a diol or mixture of such diols.

The polycarboxylic acid used in preparing the ester may be an aliphatic saturated or unsaturated acid and will generally have a total of about 24 to about 90, preferably about 24 to about 60 carbon atoms and about 2 to about 4, preferably about 2 to about 3 and more preferably about 2 carboxylic acid groups with at least about 9 up to about 42 carbon atoms, preferably about 12 to about 42, more preferably about 16 to about 22 carbon atoms between the carboxylic acid groups.

The oil insoluble glycol, which is reacted with the polycarboxylic acid, may be an alkane diol, i.e., alkylene glycol or an oxa-alkane diol, i.e., polyalkylene glycol, straight chain or branched. The alkane diol may have from about 2 to about 12 carbon atoms and preferably about 2 to about 5 carbon atoms in the molecule and the oxa-alkane diol will, generally, have from about 4 to about 200, preferably about 4 to about 50 carbon atoms. The oxa-alkane diol (polyalkylene glycol) will, of course, contain periodically repeating groups of the formula:

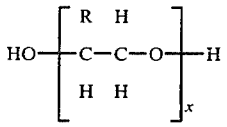

wherein R may be H, $CH_3$, $C_2H_5$ or $C_3H_7$, and x is 2 to 100, preferably 2 to 25. The preferred alkane diol or alkylene glycol is ethylene glycol and the preferred oxa-alkane diol or polyalkylene glycol is diethylene glycol. As indicated previously, glycerol may also be used in preparing the ester of polycarboxylic acid, and it is contemplated that such component will also include its higher molecular weight analogues.

While any of the esters as set forth above can be effectively used, best results are, however, obtained with such compounds wherein the carboxyl groups of the polycarboxylic acid are separated from each other by from about 16 to about 22 carbon atoms and wherein the hydroxy groups are separated from the closest carboxyl group by from about 2 to about 12 carbon atoms. Particularly desirable results have been obtained with additives prepared by esterifying a dimer of a fatty acid, particularly those containing conjugated unsaturation with a polyhydroxy compound. Such dimers are, of course, clearly taught in U.S. Pat. No. 3,180,832, which was granted on Apr. 27, 1965 and U.S. Pat. No. 3,429,817 which was granted on Feb. 25, 1969, and as there indicated, the hydrocarbon portion of the dimer or dicarboxylic acid thus obtained may contain a six member ring. The formation of the dimer from linoleic acid, oleic acid and mixtures of these acids is illustrated by the following:

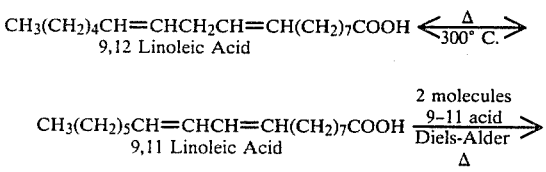

-continued

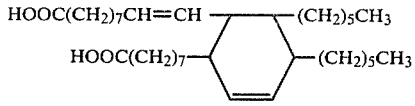

Linoleic Acid Dimer (dilinoleic acid)

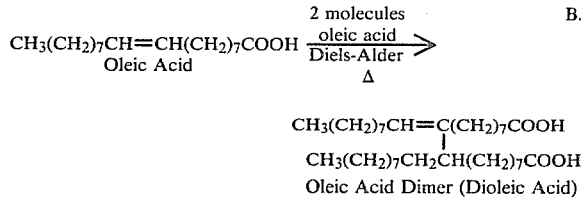

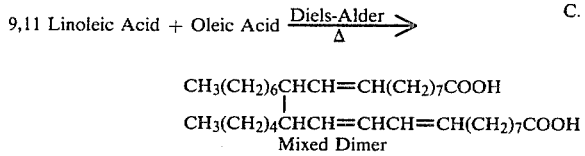

It will, of course, be appreciated that while the reactions illustrated produce the dimers, commercial application of the reactions will, generally lead to trimer formation and in some cases, the product thus obtained will contain minor amounts of unreacted monomer or monomers. As a result, commercially available dimer acids may contain as much as 25% trimer and the use of such mixtures is within the scope of the present invention.

The preferred hydroxy-substituted ester lubricity additives useful in the present invention will be the reaction product of a dimerized fatty acid, such as those illustrated, and an oil insoluble glycol and may be produced by various techniques. As previously pointed out, the preferred acid dimers are the dimers of linoleic acid, oleic acid or the mixed dimer of linoleic and oleic acids, which may also contain some monomer as well as trimer. Other specifically satisfactory glycols in addition to ethylene glycol and polyethylene glycol are, for example, propylene glycol, polypropylene glycol, butylene glycol, polybutylene glycol and the like.

The metal dithiocarbamates which are used in this invention may be represented by the following formula:

$$A[SCSNR_2]_x \qquad (I)$$

where A is a metal selected from the group consisting of molybdenum, zinc and antimony; each R is an alkyl group of 1 to 22 carbon atoms and x is an integer of 1 to 3 depending on the particular A group used. The dithiocarbamate component (I) may also be a combination of a metal derivative, as defined above, with a carbamate compound (I) where A is 1,2 dicarboethoxyethyl. Preferred compounds (I) are those wherein R is 1 to 18 and more preferably 3 to 15 carbon atoms, A is molybdenum or a combination of carbamate compounds (I), where A is molybdenum in one and A is 1,2 dicarboethoxyethyl in the other. When using a combination mixture of a metal dithiocarbamate with the ethoxyethyl component, generally at least about 25 percent by weight and preferably at least about 50 percent by weight will be the metal component. Various dithiocarbamates of this type are available commercially and many of such compounds and the preparation thereof are disclosed in Kirk-Othmer, *Encyclopedia of Chemical*

Best Available Copy

*Technology*, Second Edition, 1968, Vol. 17, pp. 513–514. Additional disclosure of such compounds and the preparation thereof may be found in "Lubricant Additives" by C. V. Smalheer et al, 1967, p. 6 and U.S. Pat. Nos. 2,450,633; 2,492,314 and 2,580,274.

The lubricating oil basestocks which may be used include the mineral lubricating oils and the synthetic lubricating oils and mixtures thereof. The synthetic oils will include diester oils such as di (2-ethylhexyl) sebacate, azelate and adipate; complex ester oils such as those formed from dicarboxylic acids, glycols and either monobasic acids or monohydric alcohols; silicone oils; sulfide esters; organic carbonates and other synthetic oils known to the art.

Other additives may be added to the oil compositions of the present invention to form a finished oil. Such additives may be the conventionally used additives including oxidation inhibitors such as phenothiazine or phenyl $\alpha$-naphthylamine; rust inhibitors such as lecithin or sorbitan monoleate; detergents such as barium phenates; pour point depressants such as copolymers of vinyl acetate with furmaric acids esters of coconut oil alcohols; viscosity index improvers such as olefin copolymers, polymethacrylates; etc. One group of particularly useful additives are the metal dialkyl dithiophosphates useful for antioxidant and antiwear properties. While any of these additives may be used in the composition of this invention, it has been found that compositions containing the ester and carbamate compounds, as defined herein, provide particularly satisfactory lubricating properties at fairly low levels of phosphorus content. Thus, preferred compositions of this invention will employ phosphorus containing additives, such as the metal dialkyl dithiophosphates, at phosphorus levels below about 0.15% by weight and preferably below about 0.1% by weight.

The lubricating oil composition of this invention will generally include a dispersant such as an oil soluble ashless dispersant. Such dispersants are well known in the art and include the nitrogen containing ashless dispersants having a relatively high molecular weight aliphatic hydrocarbon oil solubilizing group attached thereto. Particularly useful dispersants are those derived from alkenyl succinic acid or anhydrids and include the nitrogen containing compounds as well as esters of said alkenyl succinic acid or anhydride.

In general, the polycarboxylic acid and glycol ester component will be used in the lubricating oil composition at a concentration within the range of about 0.05 to about 2 parts by weight per 100 parts by weight of lubricating oil composition and preferably from about 0.1 to about 0.5. The metal dithiocarbamates and mixtures thereof will be used at a concentration of about 0.1 to about 2 parts by weight and preferably about 0.15 to about 1.5 parts by weight based on 100 parts by weight of lubricating oil composition.

The following examples are further illustrative of this invention and are not intended to be construed as limitations thereof.

EXAMPLE 1

A 10W-40SF quality automotive engine oil was prepared containing a base oil comprising about 72 parts by weight of solvent 150 neutral mineral oil and 8 parts by weight of solvent 100 neutral mineral oil, 0.2 parts by weight of an ester formed by the esterification of a dimer acid of linoleic acid and diethylene glycol and having the formula:

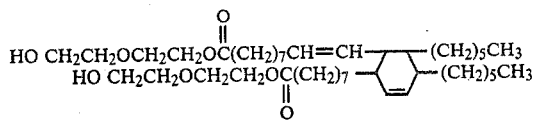

This additive is actually a mixture of the structure shown plus higher molecular weight repeating units (polymers) of this material; 1.0 parts by weight of a 50/50 by weight mixture of molybdenum dithiocarbamate having R groups of $C_{13}/C_{14}$ and 1,2 dicarboethoxyethyl dithiocarbamate having R groups of $C_4$; said carbamates are available commercially from R. T. Vanderbilt under the names Molyvan 807 and Vanlube 732; 1.1 parts by weight of zinc dialkyl dithiophosphate (80% active ingredient in diluent mineral oil) in which the alkyl groups were a mixture of such groups having between 4 and 5 carbon atoms and made by reacting $P_2S_2$ with a mixture of about 65% isobutyl alcohol and 35% amyl alcohol. The lubricant composition also contained an ashless dispersant derived from polyisobutenyl succinic anhydride, pentaerythirtol and a mixture of polyamines of the type described in U.S. Pat. No. 3,804,763. The composition also contained an oxidation inhibitor and an overbased magnesium sulfonate detergent.

The prepared composition was tested for relative friction using a ball on cylinder test described in the *Journal of the American Society of Lubrication Engineers*, entitled, "*ASLE Transactions*", Vol. 4, pages 1–11, 1961. In essence, the apparatus consists basically of a fixed metal ball loaded against a rotating cylinder. The weight on the ball and the rotation of the cylinder can be varied during any given test or from test to test. Also, the time of any given test can be varied. Generally, however, steel on steel is used at a constant load, constant rpm and a fixed time and in each of the tests of these examples, a 4 Kg load, 0.26 rpm and 70 minutes was used. The apparatus and method used is more fully described in U.S. Pat. No. 3,129,580.

The relative friction for this composition for fresh oil was 0.09 and after being oxidized for 3 hours (Lube Stability Test-LST) to simulate engine service was 0.06.

For comparison purposes, the same formulation without the ester and carbamate components was tested for relative friction and had a measurement of 0.21 for fresh oil and 0.28 after 3 hours LST. The same formulation with 0.2 parts by weight of ester and no carbamate had friction of 0.08 for fresh oil and 0.08 after three hours LST. The same formulation with 1.0 parts by weight of the dithiocarbamate mixture and no ester gave relative friction of 0.29 for fresh oil and 0.29 after three hours LST.

This data shows the particularly improved friction properties when the additive combination of this invention is used as evidenced by results of the LST (3 hour) test which is a laboratory test indicator of overall performance and better predicts fuel economy during field service than fresh oil.

EXAMPLE II

A 10W-40SE quality automotive engine oil was prepared containing a base oil comprising about 57 parts by weight of solvent 150 neutral and about 19 parts by weight of solvent 100 neutral mineral oil. It also contained 0.2 parts by weight of the ester described in Example I, 1.5 parts by weight of the dithiocarbamate mixture described in Example I, as well as other additives as described in that Example.

This composition which had 0.05 parts by weight of phosphorus content was tested for relative friction using a ball on cylinder as in Example I. The relative friction for fresh oil was 0.11 and after 3 hours LST was 0.10. Other test results using a LST of 46 hours showed a percent change in viscosity of −2.6 KV/100° C., cSt and +5 CCS, −18° C., poise.

For comparison purposes, a similar composition, containing 1.5 parts by weight of zinc dialkyl dithiophosphate as in Example I and an overall phosphorus content of 0.17 parts by weight was tested with the following results. Ball on cylinder friction, fresh oil 0.09, after 3 hours LST 0.08; percent change in viscosity using LST 46 hours was −4.7 KV/100° C., cSt and +19 CCS, −18° C., poise.

For comparison purposes, another similar composition without the ester or carbamate components, but with 1.5 parts by weight zinc dialkyl dithiophosphate and an overall phosphorus content of 0.17 parts by weight was tested. Ball on cylinder friction was 0.28 fresh oil and 0.29 after 3 hours LST; percent viscosity change using 46 hours LST was −3.9 KV/100° C., cSt and +25 CCS, −18° C., poise.

The results show the advantage of the composition of this invention, particularly for the low level phosphorus formulation, wherein minimum friction is provided while retaining good oxidation control.

EXAMPLE III

A 10W-40SF quality automotive engine oil, as in Example I, was prepared containing 0.5 weight % of an antimony dithiocarbamate $Sb[SC(S)N(C_5H_{11})_2]_3$ sold commercially as Vanlube 73 by R. T. Vanderbilt instead of the carbamate mixture used in Example I. This composition also contained 0.2 parts by weight of the ester component and 1.1 parts by weight of the zinc dialkyl dithiophosphate as shown in Example I.

The resulting composition had 0.11 parts by weight of phosphorus content and was tested for relative friction using a ball on cylinder test as in Example I. The relative friction was 0.08 for fresh oil and after 3 hours, LST was 0.07. Other results using a 46 hour LST showed a percent change in viscosity of about 7 KV/100° C., cSt and 34 CCS, −18° C., poise.

EXAMPLE IV

A similar 10W-40SF quality automotive oil, as in Example III, was prepared containing 0.5 weight % of a zinc dithiocarbamate $Zn[SC(S)N(C_5H_{11})_2]_2$, sold commercially as Vanlube AZ by R. T. Vanderbilt, instead of the antimony carbamate.

This composition also had 0.11 parts by weight phosphorus, and friction tests showed 0.08 for fresh oil, and 0.08 after the 3 hour LST. Other results using the 46 hour LST were a percent change in viscosity of −9 KV/100° C., cSt and 80 CCS, −18° C., poise.

These results show the advantage of using the lubricant compositions of this invention wherein relatively low friction can be attained with a composition having relatively reduced phosphorus levels without adversely affecting the stability of oil during service operation.

What is claimed is:

1. A lubricating oil composition with friction reducing properties comprising a major amount of lubricating oil, from about 0.05 to about 2 parts by weight of an ester of a dicarboxylic acid having from about 9 to about 42 carbon atoms between carboxylic acid groups and a glycol which is selected from the group consisting of alkane diols having from about 2 to about 12 carbon atoms or an oxa-alkane diol having from about 4 to about 200 carbon atoms, and from about 0.1 to about 2 parts by weight of a mixture of molybdenum dithiocarbamate and 1,2 dicarboethoxyethyl dithiocarbamate said dithiocarbamates having the formula:

$$A\,[SCSNR_2]_x \qquad (I)$$

where A is molybdenum or 1,2 dicarboethoxyethyl, each R is an alkyl of 1 to 22 carbon atoms and x is an integer of 1 to 3; with at least about 25 percent by weight of said mixture being said molydenum dithiocarbamate; all other weights are based on 100 parts by weight of lubricating oil composition.

2. The composition of claim 1 further comprising phosphorus containing additives wherein the total phosphorus content of the composition is less than about 0.15 parts by weight.

3. The composition of claim 2 wherein said phosphorus containing additive is zinc dialkyl dithiophosphate.

4. The composition of claim 2 wherein from about 0.1 to about 0.5 parts by weight of said ester component are used and from about 0.15 to about 1.5 parts by weight of said dithiocarbamate are used.

5. The composition of claim 4 wherein the R groups in said carbamate contain 1 to 15 carbon atoms.

6. The composition of claim 5 wherein said ester is formed from a dimer acid of a conjugated fatty acid having from about 16 to about 22 carbon atoms between carboxylic acid groups.

7. The composition of claim 6 wherein said ester is formed by the esterification of a dimer acid of linoleic acid and diethylene glycol.

8. The composition of claim 7 wherein the total phosphorus content of the composition is less than about 0.1 parts by weight.

9. The composition of claim 8 wherein said phosphorus containing additive is zinc dialkyl dithiophosphate.

* * * * *